US006718675B1

(12) United States Patent
Lu

(10) Patent No.: US 6,718,675 B1
(45) Date of Patent: Apr. 13, 2004

(54) DISPLAY GRIP FOR SPORTS EQUIPMENT

(75) Inventor: Clive S. Lu, 282 Newbridge Rd., Hicksville, NY (US) 11801

(73) Assignee: Clive S. Lu, Hicksville, NY (US)

( * ) Notice: Subject to any disclaimer, the term of this patent is extended or adjusted under 35 U.S.C. 154(b) by 0 days.

(21) Appl. No.: 10/348,653

(22) Filed: Jan. 21, 2003

Related U.S. Application Data

(60) Provisional application No. 60/416,019, filed on Oct. 4, 2002.

(51) Int. Cl.[7] ..... G09F 3/18

(52) U.S. Cl. ..... 40/661.12; 40/317; 40/661

(58) Field of Search ..... 40/661.12, 317, 40/660, 661

(56) References Cited

U.S. PATENT DOCUMENTS

| | | | | | |
|---|---|---|---|---|---|
| 1,902,438 | A | | 3/1933 | Foley | |
| 2,768,457 | A | * | 10/1956 | Biek | 40/660 |
| 3,567,237 | A | | 3/1971 | Miller, III | |
| 3,965,590 | A | * | 6/1976 | Algaze | 40/660 |
| 4,195,837 | A | * | 4/1980 | Poulin | 40/317 |
| 4,600,195 | A | * | 7/1986 | Hunter | 473/297 |
| 4,858,925 | A | * | 8/1989 | DeStefano, Jr. | 40/317 |
| 5,570,541 | A | * | 11/1996 | Hering | 40/660 |
| 5,711,720 | A | | 1/1998 | Janes et al. | |
| 5,890,308 | A | * | 4/1999 | Harrington | 40/660 |
| 6,042,484 | A | * | 3/2000 | Streit | 40/317 |
| 6,122,802 | A | | 9/2000 | Lo | |
| 6,287,221 | B1 | | 9/2001 | Pino | |
| 6,314,598 | B1 | | 11/2001 | Yates | |
| 2001/0039215 | A1 | * | 11/2001 | Buchanan | 473/297 |

* cited by examiner

*Primary Examiner*—Gary Hoge
(74) *Attorney, Agent, or Firm*—King & Schickli, PLLC

(57) ABSTRACT

A grip for displaying information on sports equipment having a gripping end includes a bottom layer overlaying the gripping end, an intermediate layer having textual information or a design placed thereon, and a substantially transparent top layer overlaying the intermediate and bottom layers. The intermediate layer faces outwardly from the bottom layer such that the information is visible, and is protected from damage by the top layer. Integral rib and groove structures may be used to assist in securing the top and bottom layers to one another. A weighted end cap may assist in providing a balanced feel to the equipment.

20 Claims, 5 Drawing Sheets

DISPLAY GRIP FOR SPORTS EQUIPMENT

This application claims the benefit of U.S. Provisional Application Serial No. 60/416,019, filed Oct. 4, 2002.

FIELD OF THE INVENTION

This invention relates generally to the field of grips or handles for articles of sporting equipment having a gripping end, such as golf clubs and tennis rackets. In particular, the present invention relates to a means for incorporating a printed media or design element into grips for sporting equipment such as golf clubs or tennis rackets.

BACKGROUND OF THE INVENTION

It is often desirable to display certain information on sporting equipment. For example, owners often elect to place their name and address on a particular piece of sports equipment as an indicia of ownership, or may wish to decorate the equipment to their liking. Manufacturers often elect to display desired information regarding the equipment, such as a logo indicating the source of the goods, on the grip. For sports equipment having a gripping end, often the most convenient location for displaying such information is the grip. For thin equipment, such as golf clubs or tennis rackets, often the grip or gripping end is the only location on the equipment large enough to allow displaying a significant amount of information. However, this must be done without interfering with or adversely affecting the user's grip. Further, simply placing a means for displaying information such as labels or plaques on the grip of an item of sports equipment exposes the label or plaque to routine wear and tear, such as friction and sweat from the user's hand, soiling, weathering from sun and rain, and the like.

Accordingly, there is a need in the art for a means for displaying desired information or decorative designs on the grip of sports equipment having a shaft for gripping, such as tennis rackets or golf clubs. The means for displaying information should protect the information being displayed from damage and exposure to wear and tear, while not interfering with the primary function of providing a secure gripping area for the user.

SUMMARY OF THE INVENTION

In one aspect the present invention provides a grip for displaying a design on sports equipment having a gripping end, comprising a bottom layer overlaying the gripping end, an intermediate layer having the design thereon, and a substantially transparent top layer overlaying the intermediate and bottom layers. The intermediate layer overlays at least a portion of the bottom layer such that said design faces outwardly from the gripping end, and is protected from damage by the top layer.

It will be appreciated that the bottom and top layers may be fabricated of any suitable material known in the art for use on sporting equipment grips, including but not limited to plastics, polymers such as polyurethane or polystyrene, rubber and rubber-like materials, latex, and the like. The intermediate layer may be fabricated of any material capable of having a design embossed or printed thereon, or molded therein during fabrication, including but not limited to plastics, polymers as described above, fabrics, metals, rubber, and the like.

Any suitable adhesive as is known in the sporting equipment art may be used to secure the bottom layer to the gripping end, to secure the intermediate layer to the bottom layer and to the top layer, and to secure the top layer over the bottom and intermediate layers. The grip of the present invention may further include an end cap of a design known in the art, having a sufficient weight to substantially balance the sports equipment. The top and bottom layers may also include cooperating rib and groove structures for securing the side edges of individual layers to one another to form the desired hollow sleeve, and for securing the top layer to the bottom layer to complete the installation of the grip on the gripping end. It will be appreciated that a combination of adhesive and rib and groove structures may be used to install the grip elements on the gripping end of the sports equipment.

The grip bottom layer may be a hollow sleeve having at least one open end, and being adapted to receive the gripping end interiorly. An end circumference of the sleeve may include a rib and groove structure for capturing a corresponding rib and groove structure on the top layer as will be described in greater detail below.

In another embodiment, the bottom layer may comprise a substantially planar sheet having two side edges, a top edge, and a bottom edge, adapted for substantially overlaying the gripping end. Each side edge may include a rib and groove structure allowing the sheet to form a hollow sleeve for receiving the gripping end therein. The sleeve formed by the planar sheet may also include a rib and groove structure near an end circumference for capturing a corresponding rib and groove structure on the top layer.

The intermediate layer having the design thereon may comprise a substantially planar sheet of any desired shape, such as square, rectangular, circular, oval, and the like, adapted to overlay at least a portion of the bottom layer. Of course, the design may comprise any desired information or shape, such as a corporate logo, an individuals name and/or address, and the like. The design may be placed on the intermediate layer by any desired method, including but not limited to embossing, printing, molding, and the like. Any suitable adhesive may be used to secure the intermediate layer to the bottom layer, or in the alternative no adhesive may be used. It will also be appreciated that the intermediate layer may be coated with a suitable adhesive on both sides, to increase the security of the connection between the bottom, intermediate, and top layers, and to prevent the intermediate layer from being inadvertently displaced.

The substantially transparent top layer may comprise a hollow sleeve having at least one open end, which maybe rolled onto the gripping end of the sports equipment. The top layer may also be a substantially planar sheet having two side edges, a top edge, and a bottom edge, adapted to overlay the installed bottom and intermediate layers. The top layer may be secured by adhesive. The top layer side edges may also include rib and groove structures as described above, allowing the side edges to interlock to form a hollow sleeve for capturing the gripping end therein. Of course, a combination of adhesive and rib and groove structures as described may be used. At least one rib and groove structure may be located near an end circumference of the sleeve formed by the top layer for capturing a corresponding rib and groove structure on the bottom layer, thereby capturing the intermediate layer therebetween.

An end cap of a type known in the art may be provided for placement on a distal end of the gripping end, either before or after the grip of the present invention is installed thereon. The end cap may be of any desired weight, typically from about 0.001 to about 100 grams. The end cap selected will typically be of a sufficient weight to provide a balanced feel to the sports equipment, thereby improving user comfort. The end cap may include a rib and groove structure on an edge thereof for capturing a corresponding rib and groove structure on the top or bottom layer of the grip of the present invention.

The bottom, intermediate, and top layers of the grip of the present invention may be of any desired thickness to result in a grip of a predetermined size. Of course, the predetermined size of the grip will be determined in accordance with the hand size of the user. Typically, each layer of the grip of the present invention may be from about 0.00001 mm to about 100 mm in thickness. Advantageously, by selecting particular materials and thicknesses thereof in fabricating the grip of the invention, it is possible to achieve a lighter weight grip without sacrificing thickness, strength, and cushioning properties of the grip.

In another aspect, the present invention provides a method for displaying a design on sports equipment having a gripping end, comprising the steps of installing a bottom layer substantially overlaying the gripping end, installing an intermediate layer having a design thereon to substantially overlay at least a portion of the bottom layer such that the design faces outwardly from the gripping end, and installing a transparent top layer to substantially overlay the intermediate and bottom layers. As described above, an adhesive, a system of cooperating rib and groove structures, or a combination thereof may be used to install the grip elements on the gripping end to accomplish the method of the present invention.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification illustrate several aspects of the present invention and, together with the description, serve to explain the principles of the invention.

In the drawing.

Reference will now be made in detail to the presently preferred embodiment of the invention, an example of which is illustrated in the accompanying drawings.

DETAILED DESCRIPTION OF THE INVENTION

Figure 1A:
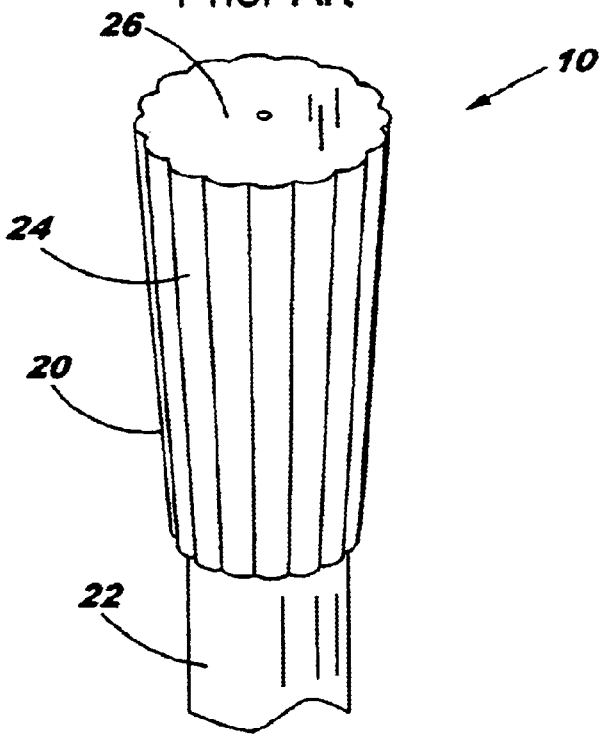
FIG. 1A Prior Art
FIGS. 1*a* and 1*b* show prior art grip designs having raised ridges for gripping.
Figure 1B:
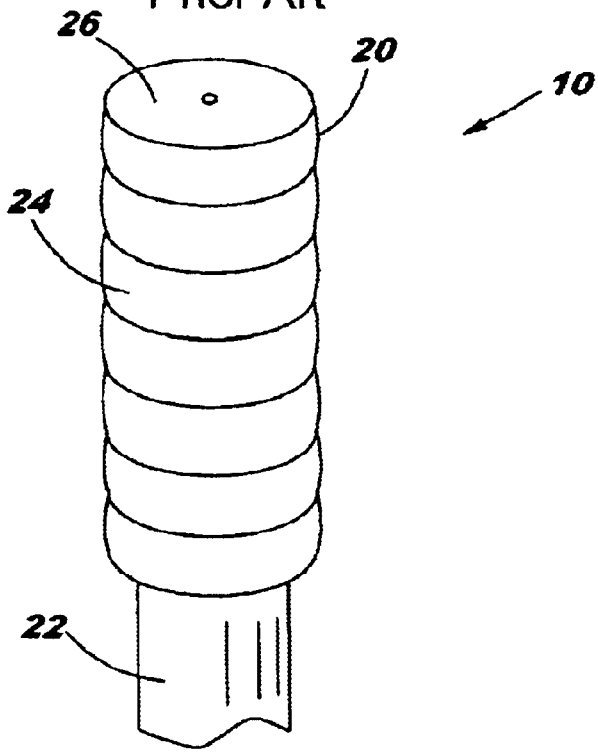
FIG. 1B Prior Art

Referring to FIGS. 1*a*–1*b*, one type of prior art grip 10 for sporting equipment (in this case a golf club) is shown comprising a hollow sleeve 20 capturing a shaft 22 therein. The sleeve includes raised sections 24, which provide cushioning and a secure grip. FIG. 1*a* shows a grip with raised sections 24 oriented in parallel to the shaft 22, while FIG. 1*b* shows a grip with raised sections 24 oriented perpendicularly to the shaft 22. These grips are generally effective for their intended purpose. However, when addition of a design such as a logo or address block is desired, the grips shown in FIGS. 1*a*–1*b* are limited in available area to the end region 26, or in the alternative a design must be applied to the gripping surface during manufacture of the grip. Retrofitting a design to the gripping surface in such a manner as to protect the design from wear is not possible.

Figure 2:
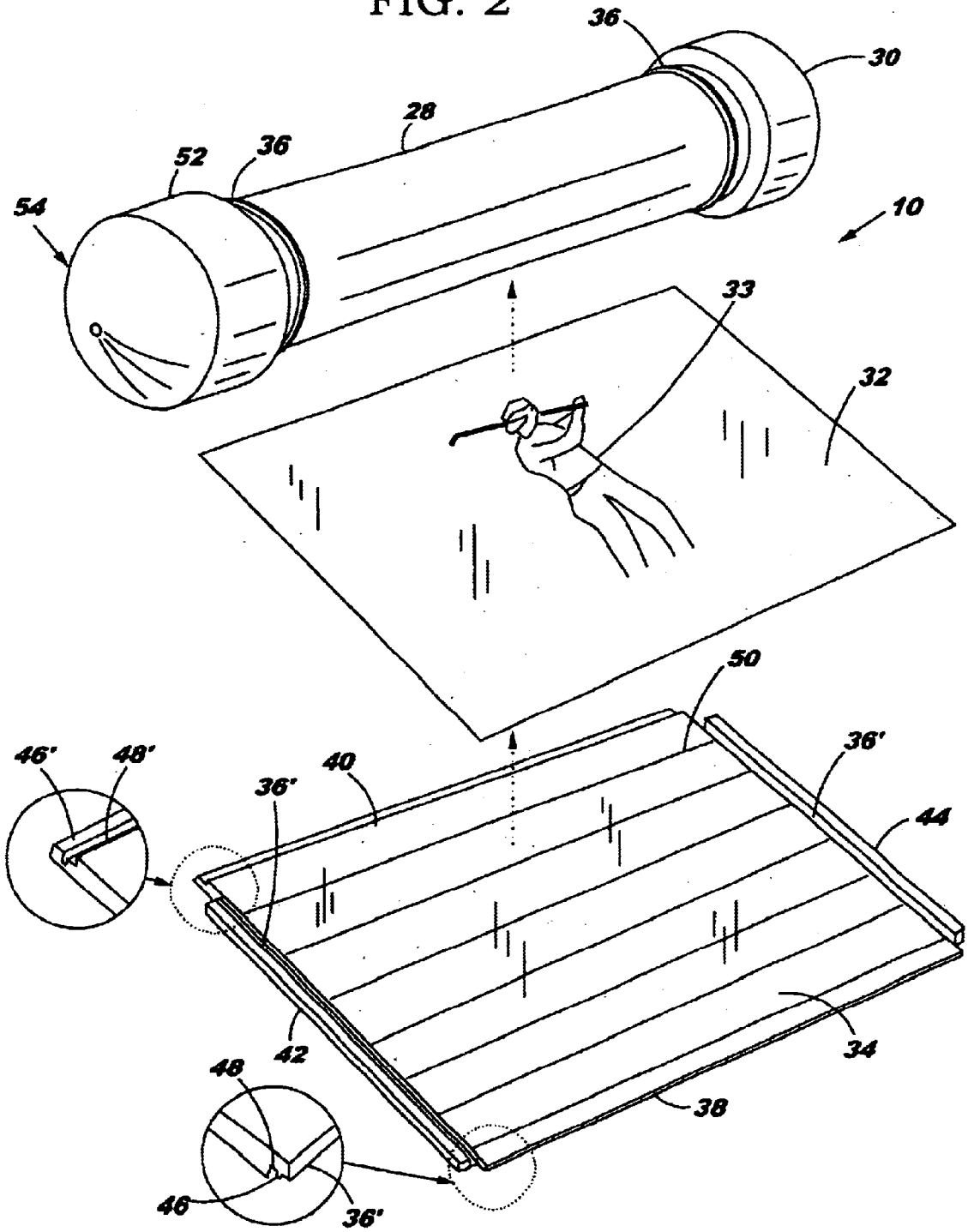
FIG. 2 illustrates an exploded view of the grip of the present invention, having a tubular bottom layer, a planar intermediate layer, and a planar top layer, with integral rib and groove structures shown in isolation.

In accordance with the need identified in the foregoing description, a novel grip 10 for sporting equipment having a gripping end is shown, which provides a means for displaying information or decorative designs. As shown in FIG. 2, the grip 10 includes a bottom layer 28 which may be a hollow sleeve adapted to engagingly receive the gripping end in an interior 30 thereof. Typically, the bottom layer 28 will be in substantially contiguous frictional contact with the gripping end. The grip 10 further includes an intermediate layer 32 having a design 33 such as a corporate logo, any desired textual information, or other decoration thereon. The intermediate layer 32 will typically substantially overlay a portion of the bottom layer 28 and be in substantially contiguous frictional contact therewith, placed such that the information or decorative design is oriented outwardly from the gripping end and the bottom layer 28.

The grip 10 further includes a top layer 34 fabricated of a thin, durable, substantially transparent material, to substantially overlay the bottom layer 28 and intermediate layer 32 and to be in at least partial contiguous frictional contact therewith. It will be appreciated that the once the top layer 34 is installed, the design on the intermediate layer 32, while clearly visible, is now protected from damage, soiling, water, and the like.

The bottom layer 28 may be fabricated from any suitable polymer such as polystyrene or polyurethane, from latex, from rubber, or from any material currently used in fabricating grips for sports equipment. Typically, the bottom layer 28 will have a thickness of from about 0.00001 mm to about 10 mm. Similarly, the protective top layer 34 may be any suitable known polymer having the desired properties of transparence and durability, but also providing the desired level of tackiness required for a slip-resistant grip. Such polymers are known in the art. Typically, the top layer will have a thickness of from about 0.00001 mm to about 10 mm. The intermediate layer 32 may be fabricated from any material capable of receiving a design by any suitable method, including but not limited to printing, molding, or embossing, including polymers, synthetic or natural fabrics (woven and non-woven), metals, and the like.

Bottom layer 28 may include at least one rib and groove structure located near an end circumference thereof. As shown in FIG. 2, rib and groove structures 36 may be provided near both end circumferences of bottom layer 28. Similarly, top layer 34 may include rib and groove structures 36' along both side edges 38, 40, top edge 42, and bottom edge 44. As shown in isolation in FIG. 2, rib and groove structures 36, 36' comprise at least one rib 46 and one groove 48 which cooperate to capture a corresponding rib and groove structure 36, 36' therein. Accordingly, top layer 34 may be wrapped around bottom layer 28, whereby the rib and groove structures 36' on side edges 38, 40 are used to form top layer 34 into a hollow sleeve encircling bottom layer 28. The rib and groove structures 36' at top end 42 and bottom end 44 of the top layer 34 may capture corresponding rib and groove structures 36 near the end circumferences of bottom layer 28, thereby affixing the top layer 34 to the bottom layer 28 with the intermediate layer 32 captured therebetween.

It will be appreciated that any suitable means for placing a translucent or transparent, durable coating over the intermediate layer 32 and top layer 34 may be used. The top layer 34 may be injection molded, or may comprise a film placed over the bottom layer 28 and intermediate layer 32 of the grip 10 of this invention by spraying on or dipping in a liquid polymer, then air-drying or heating the polymer to form a clear, protective coat. The top layer 34 may be fabricated from any suitably durable, translucent or transparent polymer allowing visualization of the design or information on the intermediate layer 32. It will also be appreciated that the top layer 34 may be fabricated to include any suitable textured surface, comprising for example concave or convex features molded, embossed, or engraved thereon, suitable for improving a user's grip. One embodiment of this feature is depicted schematically as parallel lines 50 in FIGS. 2 and 3.

Figure 3:
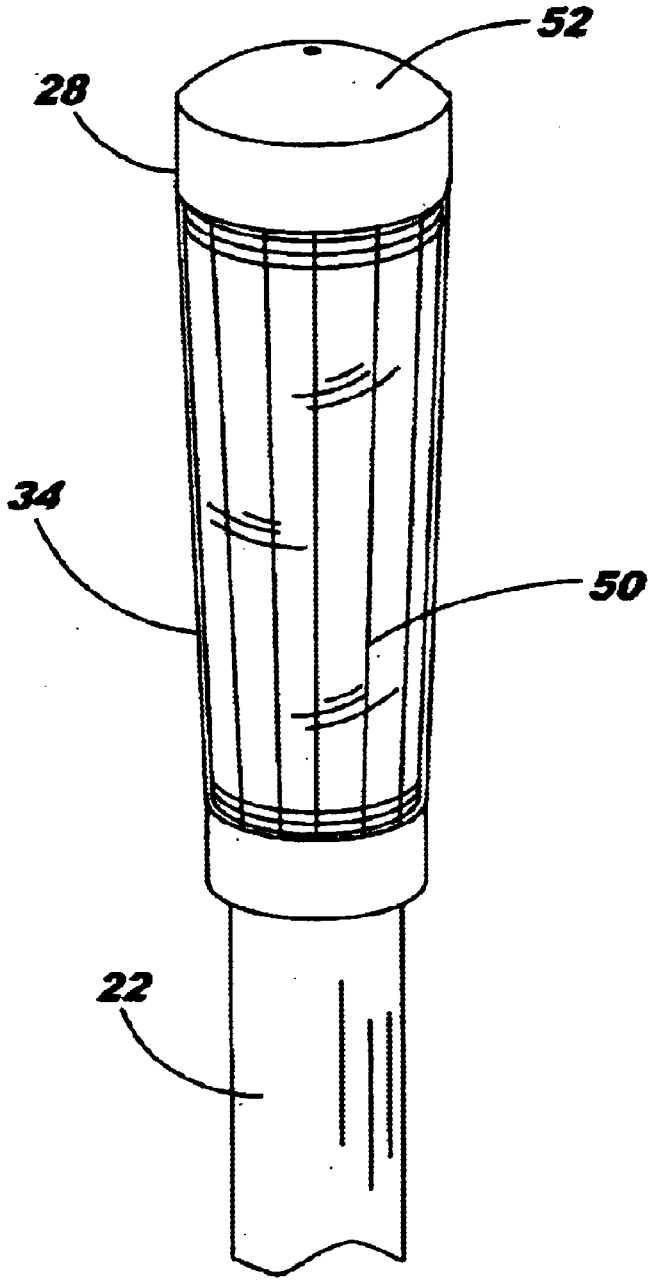
FIG. 3 shows the grip of FIG. 2 installed on a golf club.

A completed grip 10 is shown in FIG. 3, wherein top layer 34 is shown affixed to bottom layer 28 via rib and groove structures 36, 36' as described. Of course, the bond between top layer 34, intermediate layer 32, and bottom layer 28 may be strengthened or enhanced using any suitable adhesive, such as an epoxy or other conventional adhesive. Typically, if an adhesive is used to secure intermediate layer 32 to top layer 34, and to secure top layer 34 to intermediate layer 32 and bottom layer 28, it will be an adhesive of suitable transparency or translucency to allow the design (not shown) on intermediate layer 32 to remain visible.

Figure 4A:
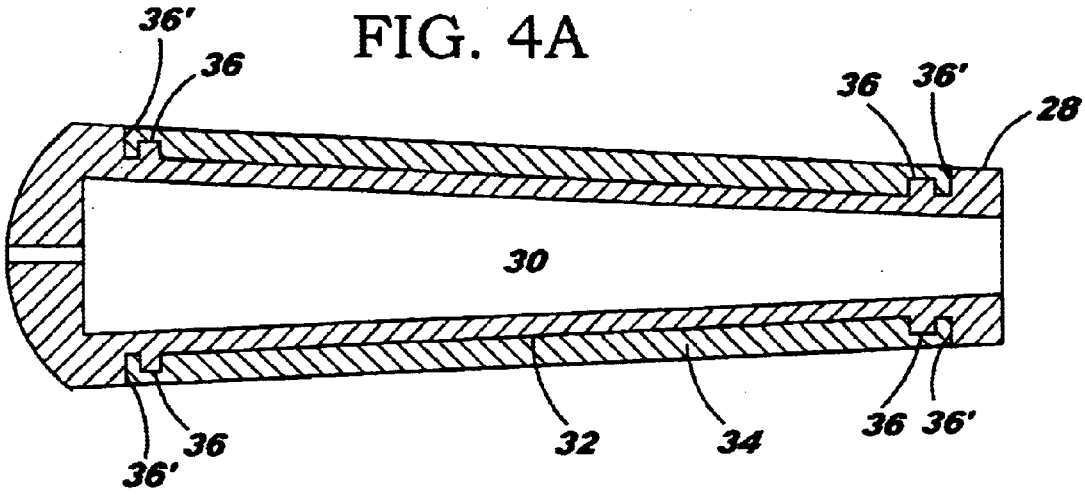
FIGS. 4*a* and 4*b* show side (FIG. 4*a*) and top (FIG. 4*b*) cross sectional views of the grip of FIGS. 2 and 3.
Figure 4B:
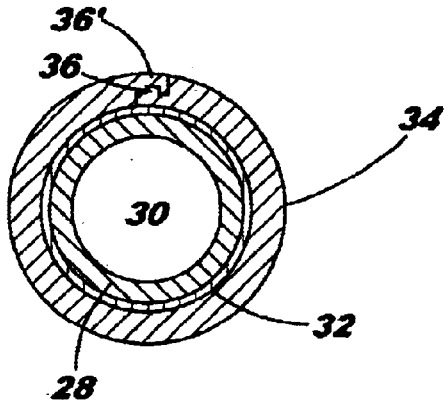

FIGS. 4*a* and 4*b* show the completed grip 10 in side (FIG. 4*a*) and top (FIG. 4*b*) cross-section. As seen therein, bottom layer 28 forms a sleeve having a hollow interior 30 for receiving the gripping end of an article of sports equipment therein. Top layer 34 is secured to bottom layer 28 using rib and groove structures 36, 36', whereby intermediate layer 32 is captured therebetween. As shown in FIG. 4*b*, top layer 34 may comprise a planar sheet secured about bottom layer 28 and intermediate layer 32 by rib and groove structures 36, 36'.

Figure 5:
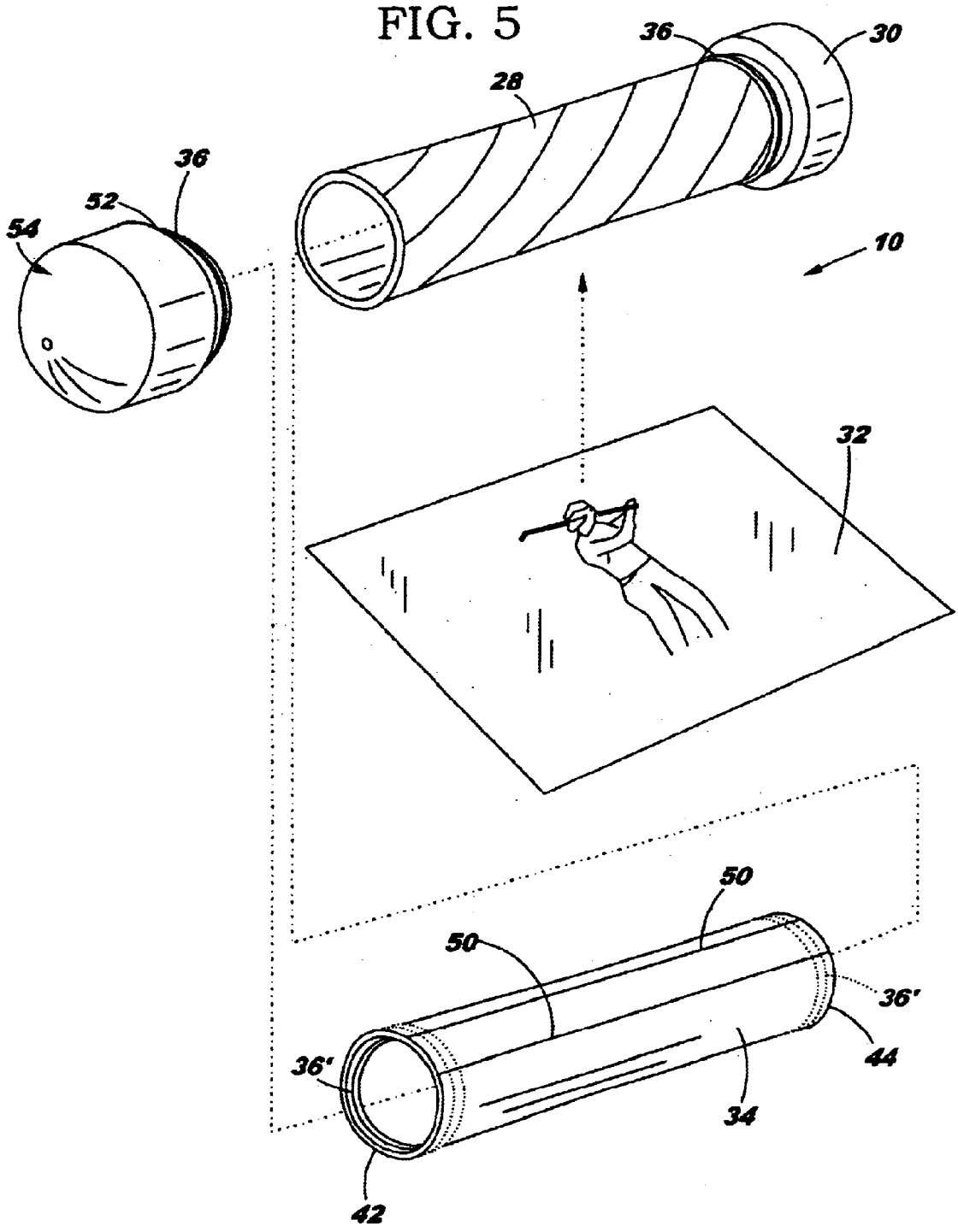
FIG. 5 illustrates an exploded view of the grip of the present invention, having a ribbon-style bottom layer, a planar intermediate layer, a tubular top layer, and an end cap.

An end cap 52 (see FIG. 2) may be secured to a distal end 54 of the gripping end of the sports equipment (not shown) or to the grip 10. The end cap 52 may be formed in any conventional design. For example, the end cap 52 may define a recess into which the gripping end is inserted, and may further include a circumferential rib and groove structure (FIG. 5) capable of interlockingly receiving, for example, the corresponding rib and groove structure 36' on the protective top layer 34. Alternatively, the end cap 52 may include a plug adapted to be inserted into a hollow shaft, thereby securing the grip material placed therein. Of course, the weight of the end cap may be varied as desired to alter the swing weight and balance of the sports equipment to the user's liking.

It will be appreciated that the grip of the present invention provides several advantages over conventional grips. Using the grip of this invention, it is possible to display information, decorative designs, logos, and the like on the grip of sports equipment such as golf clubs and tennis rackets without fear that the item being displayed will be lost, scuffed, dirtied, or wetted and without compromising the desirable properties of the grip. Using the grip of the present invention, by including several layers of light polymers instead of a single layer of a thicker, heavier polymer, it is possible to reduce overall weight of the sports equipment without sacrificing grip thickness.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, the bottom layer may be a helical strip or ribbon for wrapping around the gripping end (see FIG. 5). Such ribbon type grips are known in the art. Referring again to FIG. 5, the substantially transparent top layer may comprise a hollow sleeve having at least one open end, which may be rolled or slipped onto the gripping end of the sports equipment. The embodiment described was chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A grip for displaying a design on sports equipment having a gripping end, comprising:

a bottom layer overlaying said gripping end;

an intermediate layer having said design thereon, said intermediate layer overlaying and in substantially contiguous contact with at least a portion of said bottom layer such that said design faces outwardly from the gripping end; and a substantially transparent top layer overlaying and in substantially contiguous contact with at least said intermediate layer;

wherein said top layer, when overlaying the intermediate layer, bottom layer, and gripping end, substantially prevents fluid communication between an exterior of the top layer and an interior thereof.

2. The grip of claim 1, further including an end cap.

3. The grip of claim 2, wherein said end cap is weighted to substantially balance said sports equipment and further includes at least one rib and groove structure near an end circumference thereof for capturing a corresponding rib and groove structure located on said top layer.

4. The grip as disclosed in claim 2, wherein said end cap includes at least one rib and groove structure around a circumference thereof for capturing a corresponding rib and groove structure located on said bottom or top layer.

5. The grip as disclosed in claim 1, wherein said bottom layer is a hollow sleeve having at least one open end, said hollow sleeve being adapted to receive said gripping end in an interior thereof.

6. The grip as disclosed in claim 5, further including at least one rib and groove structure located near an end circumference of said sleeve for capturing a corresponding rib and groove structure located on said top layer.

7. The grip as disclosed in claim 1, wherein said bottom layer comprises a strip or ribbon having a first and second side edge and two ends for spirally wrapping around said gripping end with said first and second side edges overlapping, said side edges being in a substantially parallel orientation and having a substantially greater length than said ends.

8. The grip as disclosed in claim 7, wherein said strip or ribbon side edges each include a cooperating rib and groove structure for interlocking said first side edge with said second side edge to form a hollow sleeve having at least one open end.

9. The grip as disclosed in claim 8, further including at least one rib and groove structure located near an end circumference of said sleeve for capturing a corresponding rib and groove structure located on said top layer.

10. The grip as disclosed in claim 1, wherein said bottom layer comprises a substantially planar sheet having two side edges, a top edge, and a bottom edge, said planar sheet adapted for substantially overlaying a gripping end of the shaft.

11. The grip as disclosed in claim 10, wherein each sheet side edge further includes a cooperating rib and groove structure for interlocking said side edges to form a hollow sleeve for receiving said gripping end in an interior thereof.

12. The grip as disclosed in claim 11, further including at least one rib and groove structure located near an end circumference of said sleeve for capturing a corresponding rib and groove structure located on said top layer.

13. The grip as disclosed in claim 1, wherein said intermediate layer having said design thereon comprises a substantially planar sheet adapted to overlay at least a portion of said bottom layer.

14. The grip as disclosed in claim 13, wherein said design is printed on said intermediate layer.

15. The grip as disclosed in claim 1, wherein said substantially transparent top layer comprises a hollow sleeve having at least one open end, said top layer adapted to receive said gripping end in an interior thereof.

16. The grip as disclosed in claim 15, further including at least one rib and groove structure located near an end circumference of said sleeve for capturing a corresponding rib and groove structure located on said bottom layer.

17. The grip as disclosed in claim 1, wherein said substantially transparent top layer comprises a substantially planar sheet having two side edges, a top edge, and a bottom edge.

18. The grip as disclosed in claim 17, wherein each sheet side edge further includes a cooperating rib and groove structure for interlocking said side edges to form a hollow sleeve for receiving said gripping end, bottom, and intermediate layers in an interior thereof.

19. The grip as disclosed in claim 18, further including at least one rib and groove structure located near an end circumference of said sleeve for capturing a corresponding rib and groove structure located on said bottom layer.

20. A method for displaying a design on sports equipment having a gripping end, comprising the steps of:

placing a bottom layer to substantially overlay said gripping end;

placing an intermediate layer having said design thereon to substantially overlay and be in substantially contiguous contact with at least a portion of said bottom layer such that said design faces outwardly from the gripping end; and placing a substantially transparent top layer to substantially overlay and be in substantially contiguous contact with at least said intermediate layer;

wherein said top layer, when overlaying the intermediate layer bottom layer, and gripping end, substantially prevents fluid communication between an exterior of the top layer and an interior thereof.

* * * * *